US005391960A

United States Patent [19]

Moribayashi et al.

[11] Patent Number: 5,391,960

[45] Date of Patent: Feb. 21, 1995

[54] COLD CATHODE TUBE FOR GENERATING LIGHT WITH UNIFORM INTENSITY ALONG THE TUBE

[75] Inventors: Takashi Moribayashi; Kouji Tanemura, both of Kanagawa, Japan

[73] Assignee: Stanley Electric Co., Ltd., Tokyo, Japan

[21] Appl. No.: 871,763

[22] Filed: Apr. 21, 1992

[30] Foreign Application Priority Data

Jun. 27, 1991 [JP] Japan ..... 3-057088[U]

[51] Int. Cl.[6] ..... H01J 7/44

[52] U.S. Cl. ..... 313/594; 313/234; 313/283; 313/291; 313/601; 313/607; 315/330

[58] Field of Search ..... 313/594, 581, 596, 601, 313/607, 631, 283, 291, 234; 315/268, 330, DIG. 5, DIG. 7, 341

[56] References Cited

U.S. PATENT DOCUMENTS 2,094,680 10/1937 Schouwstra ..... 313/594 X
2,200,950 5/1940 Dorgelo ..... 313/594 X
2,269,338 1/1942 Edgerton et al. ..... 313/594 X
4,065,370 12/1977 Noble et al. ..... 313/594 X
4,415,840 11/1983 Baumeister ..... 313/594 X
4,499,406 2/1985 Saburo ..... 313/594 X

FOREIGN PATENT DOCUMENTS 0191954 11/1982 Japan ..... 313/601
0209050 12/1983 Japan ..... 313/594
0053056 4/1990 Japan ..... 313/594

*Primary Examiner*—Donald J. Yusko
*Assistant Examiner*—Ashok Patel
*Attorney, Agent, or Firm*—Nixon & Vanderhye

[57] ABSTRACT

A cold cathode tube in which an auxiliary electrode formed of an electric conductive material is provided on an outer surface of a cylindrical tube element so as to extend over substantially a half of the tube element from one end thereof to a location in the neighborhood of a center of the tube element along a longitudinal direction, and a longer one of a pair of lead wires from a power source section is connected to one of a pair of electrodes on the side where the auxiliary electrode is provided.

1 Claim, 1 Drawing Sheet

COLD CATHODE TUBE FOR GENERATING LIGHT WITH UNIFORM INTENSITY ALONG THE TUBE

BACKGROUND OF THE INVENTION

The present invention relates to a cold cathode tube which produces light intensity or luminous intensity uniform with respect to a longitudinal direction of the tube for use in back illumination of a transmitting-type liquid-crystal display apparatus, back illumination of an ornamental or decorative sign board or billboard, or the like.

A cold cathode tube of the kind referred to above has conventionally been arranged as shown in FIG. 2 of the attached drawings. Specifically, a cold cathode tube 1 is arranged such that a pair of electrodes 3 and 4 are disposed respectively adjacent to both ends of a tube element 2 which is composed of a cylindrical glass material or the like.

According to the cold cathode tube 1 arranged in this manner, voltage from an electric power source section 5 is applied to the electrodes 3 and 4, whereby electric discharge occurs between tile electrodes 3 and 4. Electrons so discharged are impinge against a fluorescent or luminescent material coated on an inner wall of the tube element 2, whereby a light is emitted. At the start of the electric discharge, the voltage applied to the electrodes 3 and 4 is set relatively high. After the initial electric discharge, the voltage is reduced to simply maintain the electric discharge. Thus, an attempt is made to reduce electric-power consumption and to miniaturize the power-supply transformer to reduce cost.

In the cold cathode tube 1 having the arrangement, as shown in FIG. 2, a deactivated condition may be generated due to a voltage drop after start of the electric discharge, with respect to the electrode to which a longer one of lead wires to the respective electrodes 3 and 4 from the power source section 5 is connected, that is, in the illustrated example, tile electrode 4. Thus, luminous intensity is not uniform over an entire length of the tube element 2.

In FIG. 3, a cold cathode tube 1' is known in which the cold cathode tube 1' is provided with an auxiliary electrode 6 formed of an electric conductive material so as to extend over the entire length of the tube element 2 along its longitudinal direction at an outer surface of tile tube element 2. A deactivated condition is eliminated near the electrode 4 to which the longer lead wire is connected.

According to the cold cathode tube 1' arranged as described above, electric discharge is conducted by provision of the auxiliary electrode 6 with respect to the electrode 4 to which the longer lead wire is connected, whereby there exists a sufficient amount of electrons. Accordingly, a deactivated condition does not occur near electrode 4.

In the cold cathode tube 1' arranged in this manner, however, when voltage after start of the electric discharge similarly drops at an area in the vicinity of the center of the tube element 2, a deactivated condition may occur. This is because electrons generated due to the electric discharge are absorbed by the auxiliary electrode 6 which extends over the entire length of the tube element 2.

SUMMARY OF THE INVENTION

It is therefore an object of the invention to provide a cold cathode tube in which, even when voltage applied to a pair of electrodes drops after start of electric discharge, a substantially uniform luminous intensity is produced over an entire length of a tube element.

According to the invention, there is provided a cold cathode tube comprising:

- a cylindrical tube element having first and second ends;
- an auxiliary electrode provided on an outer surface of the tube element, the auxiliary electrode being formed of an electric conductive material extending over substantially a half of the tube element from the first end to a location near the center of the tube element along a longitudinal direction thereof;
- a pair of electrodes arranged adjacent respectively to the first and second ends of the tube element;
- an electric power source and
- a pair of lead wires extending from the electric power source respectively to the pair of electrodes,
- wherein a longer one of the pair of lead wires is connected to one of the pair of electrodes arranged adjacent to the first end of the tube element.

With the above arrangement of the invention, when voltage is applied to the pair of electrodes to start electric discharge and, subsequently, the voltage drops to maintain the electric discharge, since the auxiliary electrode is provided along the longitudinal direction of the tube element on the outer surface of substantially half of the tube element on the side of the first electrode to which the longer lead wire is connected, a sufficient amount of electrons is generated due to the auxiliary electrode in the area of the first electrode. Further, since the auxiliary electrode is not provided on the outer surface of the substantially remaining half of the tube element on the side of the second electrode, not all electrons generated due to the electric discharge are absorbed by the auxiliary electrode. Accordingly, in any area of the tube element, there is no position along the tube where a deactivated condition occurs. Thus, there is produced luminous intensity which is uniform over the entire length of the tube element.

Accordingly, the cold cathode tube according to the invention is suitable for back illumination of a transmitting-type liquid-crystal display apparatus, back illumination of an ornamental or decorative sign board or billboard, or the like.

DETAILED DESCRIPTION OF THE DRAWINGS

DESCRIPTION OF THE EMBODIMENTS

The invention will hereunder be described in detail with reference to an exemplary embodiment illustrated in FIG. 1.

Figure 1:
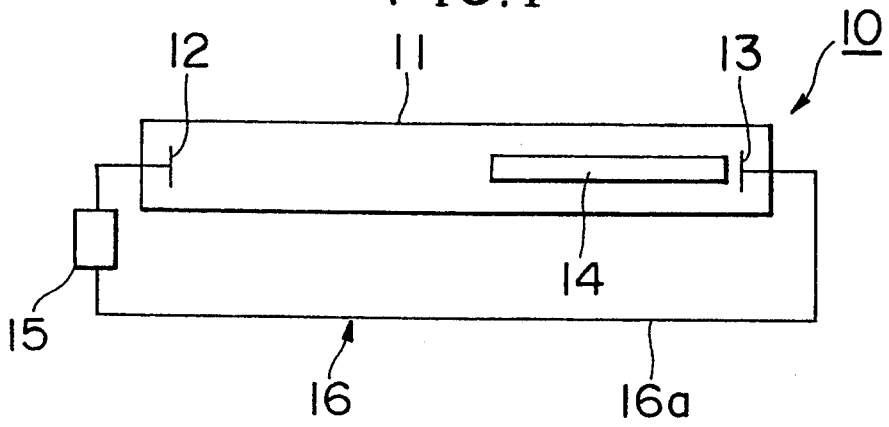
FIG. 1 is a schematic view showing a cold cathode tube according to an embodiment of the invention.
Figure 2:
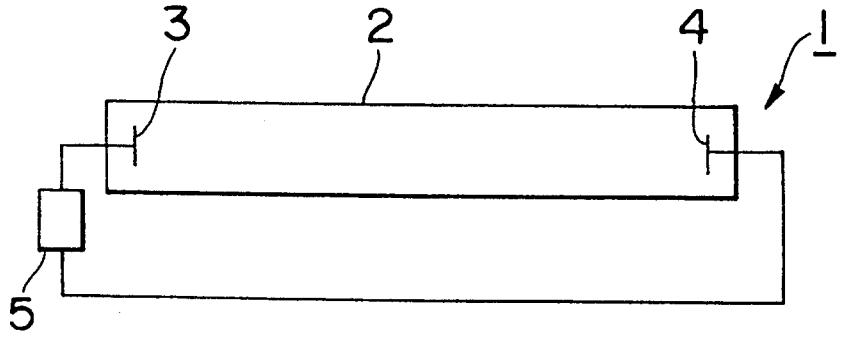
FIG.2 PRIOR ART
FIG. 2 is a schematic view showing an example of a conventional cold cathode tube.
Figure 3:
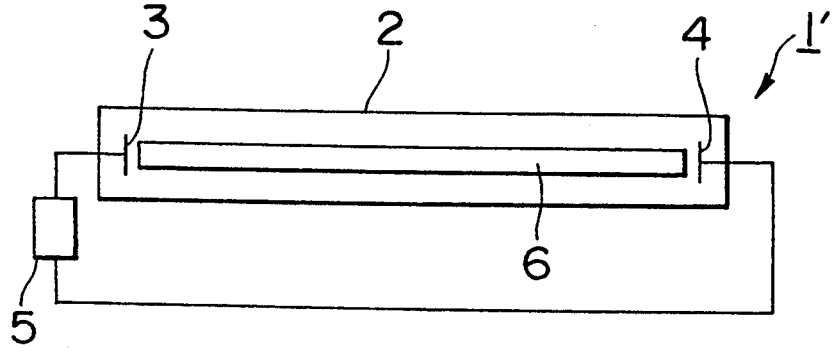
FIG.3 PRIOR ART
FIG. 3 is a schematic view showing an example of another conventional cold cathode tube provided with an auxiliary electrode.

FIG. 1 shows an embodiment of a cold cathode tube 10 according to the invention. The cold cathode tube 10 is arranged such that a pair of electrodes 12 and 13 are disposed respectively within locations near both ends of a tube element 11 which is formed of a cylindrical glass material or the like. Further, an auxiliary electrode 14 is provided on an outer surface of the tube element 11 so as to extend over substantially the half of the tube element 11 from one end thereof to a location near the center of the tube element 11 along a longitudinal direction thereof.

The auxiliary electrode 14 is formed of an electric conductive material, and is formed on the surface of the tube element 11 by, for example, printing or the like.

The cold cathode tube 10 according to the invention has been arranged as described above. When the cold cathode tube 10 is turned on, a pair of lead wires 16 from a power source section 15 are first connected respectively to the electrodes 12 and 13. At that time, a longer one 16*a* of the lead wires 16 from the power source section 15 is connected to the electrode 13 on the side where the auxiliary electrode 14 is provided.

In this manner, the power source section 15 is connected to the cold cathode tube 10, and relatively high voltage is applied to the electrodes 12 and 13, whereby electric discharge starts at a location between the electrodes 12 and 13. By doing so, electrons are generated within the tube element 11. These electrons are applied to or impinge against a fluorescent or luminescent material which is coated on an inner wall of the tube element 11, whereby a light is emitted toward the outside.

Subsequently, as the voltage from the power source section 15 drops to such a degree that the electric discharge can be maintained, since the auxiliary electrode 14 is provided along the longitudinal direction on the outer surface of substantially half of the tube element 11 on the side of the electrode 13 to which the longer lead wire 16*a* is connected, a sufficient amount of electrons is generated by the auxiliary electrode 14 in an area of the electrode 13. Thus, a deactivated condition does not occur in the area of the electrode 13.

Further, since the auxiliary electrode 14 is not provided on the outer surface of the remaining half of the tube element 11 on the side of the other electrode 12, and since the auxiliary electrode 14 is small-sized as a whole, the amount of electrons absorbed by the auxiliary electrode 14 is relatively small. Accordingly, since plenty of electrons generated due to the electric discharge are not absorbed, a deactivated condition does not occur at a location in the vicinity of the center of the tube element 11.

What is claimed is:

1. A cold cathode tube comprising:

a cylindrical tube element having first and second ends;

an auxiliary electrode formed of an electrically conductive material and extending along less than half of said tube element from said first end;

first and second electrodes arranged respectively adjacent to said first and second ends of said tube element;

an electric power source; and a pair of lead wires extending from said electric power source to said pair of electrodes, wherein a longer one of said pair of lead wires is connected to said first electrode which is arranged adjacent to said first end of said tube element.

* * * * *